US007240672B2

(12) United States Patent
Peck et al.

(10) Patent No.: US 7,240,672 B2
(45) Date of Patent: Jul. 10, 2007

(54) ADJUSTABLE TRIGGER PRESSURE ARCHERY RELEASE (STEALTH)

(75) Inventors: Paul Peck, North Fond du Lac, WI (US); Jeffrey A. Eckert, North Fond du Lac, WI (US); Lynn A. Tentler, Fond du Lac, WI (US)

(73) Assignee: Tru-Fire Corporation, North Fond du Lac, WI (US)

( * ) Notice: Subject to any disclaimer, the term of this patent is extended or adjusted under 35 U.S.C. 154(b) by 109 days.

(21) Appl. No.: 11/043,373

(22) Filed: Jan. 26, 2005

(65) Prior Publication Data

US 2006/0162707 A1 Jul. 27, 2006

(51) Int. Cl.
*F41B 5/18* (2006.01)

(52) U.S. Cl. ..... 124/35.2

(58) Field of Classification Search ..... 124/35.2
See application file for complete search history.

(56) References Cited

U.S. PATENT DOCUMENTS

| | | | |
|---|---|---|---|
| 228,302 | A | 6/1880 | Beard |
| 750,988 | A | 2/1904 | Lots |
| 1,542,159 | A | 6/1925 | Maxwell |
| 2,000,015 | A | 5/1935 | Flury |
| 2,041,944 | A | 5/1936 | Mestekin |
| 2,394,858 | A | 2/1946 | Hickman |
| 2,420,435 | A | 5/1947 | Lackow |
| 2,440,728 | A | 5/1948 | Siegal |
| 2,449,885 | A | 9/1948 | Domler |
| 2,488,597 | A | 11/1949 | Konold |
| 2,637,311 | A | 5/1953 | Rose |
| 2,819,707 | A | 1/1958 | Kayfes et al. |
| 2,929,372 | A | 3/1960 | Vance |
| 2,936,749 | A | 5/1960 | Chellstorp |
| 2,996,059 | A | 8/1961 | Vance |
| 3,004,532 | A | 10/1961 | Vance |
| 3,028,852 | A | 4/1962 | Sutton, Jr. |
| 3,072,115 | A | 1/1963 | Johnson |
| 3,604,407 | A | 9/1971 | Wilson |
| 3,672,346 | A | 6/1972 | Plumb |
| 3,749,076 | A | 7/1973 | Suski et al. |
| 3,815,908 | A | 6/1974 | Hashimoto |

(Continued)

OTHER PUBLICATIONS

Article from website www.trufire.com entitled "Tru-Fire Release Guide", Sep. 15, 2003, 2 p.

(Continued)

*Primary Examiner*—John A. Ricci
(74) *Attorney, Agent, or Firm*—Gerald E. Helget; Nelson R. Capes; Briggs and Morgan, P.A.

(57) ABSTRACT

An adjustable trigger pressure archery release including a bayonet mounted trigger utilizing an actuator ramp to reduce trigger travel. The caliper jaws and cam profile combine to create an automatic closing action to close the release, whereby rearward pulling or squeezing movement of the trigger engages the caliper jaws to an open bow string or string loop apparatus receiving condition, and relaxing or releasing movement of the trigger closes the caliper jaws into a string retaining position. The release includes an independent mechanism for permitting adjustment of the trigger pressure force, without affecting trigger travel including frictional means of maintaining selected setting. The release head is universally adjustable or lockable relative to a wrist strap or similar mounting.

31 Claims, 3 Drawing Sheets

U.S. PATENT DOCUMENTS

| | | | |
|---|---|---|---|
| 3,845,752 | A | 11/1974 | Barner |
| 3,857,379 | A | 12/1974 | Burghardt |
| 3,873,068 | A | 3/1975 | Allen |
| 3,890,692 | A | 6/1975 | Jandura, Jr. |
| 3,898,974 | A | 8/1975 | Keck |
| 3,921,615 | A | 11/1975 | Dodge |
| 3,948,243 | A | 4/1976 | Gazzara, Sr. |
| 3,954,095 | A | 5/1976 | Lewis |
| 3,998,202 | A | 12/1976 | Boyko |
| 4,004,564 | A | 1/1977 | Castonguay |
| 4,009,703 | A | 3/1977 | Cunningham, Sr. |
| 4,036,204 | A | 7/1977 | Scott |
| 4,041,926 | A | 8/1977 | Troncoso, Jr. et al. |
| 4,047,250 | A | 9/1977 | Norman |
| 4,062,339 | A | 12/1977 | Wilson |
| 4,066,060 | A | 1/1978 | Napier |
| 4,083,348 | A | 4/1978 | Fletcher |
| 4,105,011 | A | 8/1978 | Chism |
| 4,151,825 | A | 5/1979 | Cook |
| 4,160,437 | A | 7/1979 | Fletcher |
| 4,193,135 | A | 3/1980 | Rhee |
| 4,249,507 | A | 2/1981 | Marra |
| 4,257,386 | A | 3/1981 | Gazzara |
| 4,282,851 | A | 8/1981 | Lyons |
| 4,308,851 | A | 1/1982 | Kaine, Jr. et al. |
| 4,316,443 | A | 2/1982 | Giacomo |
| 4,392,475 | A | 7/1983 | Fletcher |
| 4,403,594 | A | 9/1983 | Todd |
| 4,407,260 | A | 10/1983 | Lyons |
| 4,426,989 | A | 1/1984 | Sutton |
| 4,476,845 | A | 10/1984 | Rickard |
| 4,485,798 | A | 12/1984 | Hamm |
| 4,489,705 | A | 12/1984 | Larson |
| 4,498,448 | A | 2/1985 | Fletcher |
| 4,509,497 | A | 4/1985 | Garvison |
| 4,527,536 | A | 7/1985 | Smith |
| 4,567,875 | A | 2/1986 | Fletcher |
| 4,574,767 | A | 3/1986 | Gazzara |
| 4,584,983 | A | 4/1986 | Ament |
| 4,603,676 | A | 8/1986 | Luoma |
| 4,620,523 | A | 11/1986 | Peck |
| 4,625,705 | A | 12/1986 | Willits |
| 4,672,945 | A | 6/1987 | Carlton |
| 4,674,469 | A | 6/1987 | Peck |
| 4,691,683 | A | 9/1987 | Peck |
| 4,722,319 | A | 2/1988 | Brady |
| 4,791,908 | A | 12/1988 | Pellis |
| 4,831,997 | A | 5/1989 | Greene |
| 4,854,293 | A | 8/1989 | Roberts |
| 4,860,720 | A | 8/1989 | Todd |
| 4,881,516 | A | 11/1989 | Peck |
| 4,909,232 | A | 3/1990 | Carella |
| 4,926,835 | A | 5/1990 | Peck |
| 4,930,485 | A | 6/1990 | Kopper |
| 4,938,487 | A | 7/1990 | Ponsart |
| 4,949,698 | A | 8/1990 | Burnham |
| 4,958,758 | A | 9/1990 | Tipple et al. |
| 4,969,448 | A | 11/1990 | Beyer |
| 4,981,128 | A | 1/1991 | Garvison |
| 4,982,718 | A | 1/1991 | Hamm et al. |
| 5,009,214 | A | 4/1991 | Wilde |
| 5,014,689 | A | 5/1991 | Meunchen et al. |
| 5,016,603 | A | 5/1991 | Tentler |
| 5,020,508 | A | 6/1991 | Greene, Jr. |
| 5,025,772 | A | 6/1991 | Stevenson |
| 5,027,786 | A | 7/1991 | Peck |
| D320,254 | S | 9/1991 | Peck |
| 5,067,472 | A | 11/1991 | Vogel et al. |
| 5,070,854 | A | 12/1991 | Peck |
| 5,076,251 | A | 12/1991 | Peck |
| 5,078,116 | A | 1/1992 | Peck |
| 5,103,796 | A | 4/1992 | Peck |
| 5,170,771 | A | 12/1992 | Peck |
| 5,261,581 | A | 11/1993 | Harden, Sr. |
| 5,263,466 | A | 11/1993 | Peck |
| 5,307,788 | A | 5/1994 | Peck |
| 5,318,004 | A | 6/1994 | Peck |
| 5,318,005 | A | 6/1994 | Mayer |
| 5,323,754 | A | 6/1994 | Pittman |
| 5,357,939 | A | 10/1994 | Tentler et al. |
| 5,359,983 | A | 11/1994 | Peck |
| 5,364,148 | A | 11/1994 | Bartocci |
| 5,370,102 | A | 12/1994 | Peck |
| 5,394,639 | A | 3/1995 | Tentler |
| 5,417,197 | A | 5/1995 | Bankstahl |
| 5,448,983 | A | 9/1995 | Scott |
| 5,544,926 | A | 8/1996 | Ravencroft |
| 5,558,077 | A | 9/1996 | Linsmeyer |
| 5,564,407 | A | 10/1996 | Linsmeyer |
| 5,582,158 | A | 12/1996 | Linsmeyer |
| 5,595,167 | A | 1/1997 | Scott |
| 5,596,977 | A | 1/1997 | Scott |
| 5,615,662 | A | 4/1997 | Tentler et al. |
| 5,653,213 | A | 8/1997 | Linsmeyer |
| 5,653,214 | A | 8/1997 | Lynn |
| 5,680,851 | A | 10/1997 | Summers |
| 5,680,852 | A | 10/1997 | Tentler et al. |
| 5,685,286 | A | 11/1997 | Summers |
| 5,715,805 | A | 2/1998 | Summers et al. |
| 5,722,284 | A | 3/1998 | Linsmeyer |
| 5,765,536 | A | 6/1998 | Scott |
| 5,803,068 | A | 9/1998 | Summers |
| 5,850,825 | A | 12/1998 | Scott |
| 5,850,827 | A | 12/1998 | Peck |
| 5,857,452 | A | 1/1999 | Troncoso |
| 5,871,004 | A | 2/1999 | Garvison |
| 5,904,135 | A | 5/1999 | Summers et al. |
| 5,937,841 | A | 8/1999 | Summers et al. |
| 5,937,842 | A | 8/1999 | Summers et al. |
| 5,941,225 | A | 8/1999 | Tentler et al. |
| 5,957,741 | A | 9/1999 | Evans |
| RE36,555 | E | 2/2000 | Tentler |
| 6,032,661 | A | 3/2000 | Goff et al. |
| 6,058,919 | A | 5/2000 | Davis |
| 6,058,920 | A | 5/2000 | Tentler |
| 6,125,833 | A | 10/2000 | Tentler et al. |
| 6,173,706 | B1 | 1/2001 | McConnell |
| 6,173,707 | B1 | 1/2001 | Howell et al. |
| 6,205,991 | B1 | 3/2001 | Summers et al. |
| 6,213,113 | B1 | 4/2001 | Goover et al. |
| 6,237,584 | B1 | 5/2001 | Sims |
| 6,247,467 | B1 | 6/2001 | Siegfried |
| 6,253,753 | B1 | 7/2001 | Blum et al. |
| 6,302,093 | B1 | 10/2001 | Holland |
| 6,478,020 | B1 | 11/2002 | Rentz |
| 6,481,430 | B1 | 11/2002 | Lightcap |
| 6,484,710 | B1 | 11/2002 | Summers et al. |
| 6,571,786 | B2 | 6/2003 | Summers et al. |
| 6,584,966 | B1 | 7/2003 | Summers et al. |
| 6,606,984 | B2 | 8/2003 | Mugg |
| 6,631,709 | B2 | 10/2003 | Carter et al. |
| 6,647,976 | B2 | 11/2003 | Summers et al. |
| 6,763,819 | B2 | 7/2004 | Eckert |
| D501,908 | S | 2/2005 | Tentler |
| 6,945,241 | B2 | 9/2005 | Pellerite |
| RE38,833 | E | 10/2005 | Linsmeyer |
| 6,953,035 | B1 | 10/2005 | Summers et al. |
| 6,957,647 | B2 | 10/2005 | Evans et al. |
| 2003/0029428 | A1 | 2/2003 | Summers et al. |

| | | | |
|---|---|---|---|
| 2003/0037778 | A1 | 2/2003 | Carter et al. |
| 2003/0094166 | A1 | 5/2003 | Summers et al. |
| 2003/0159682 | A1 | 8/2003 | Pellerite |
| 2003/0230295 | A1 | 12/2003 | Jones |
| 2004/0074482 | A1 | 4/2004 | Jones |
| 2004/0079351 | A1 | 4/2004 | Summers et al. |

OTHER PUBLICATIONS

"T.R.U. Ball Release Products" catalog, 1996.

"HHA Sports 1997 Archery Catalog", 1997.

"T.R.U. Ball Release Products" catalog, 1998.

ADJUSTABLE TRIGGER PRESSURE ARCHERY RELEASE (STEALTH)

BACKGROUND OF THE INVENTION

The present invention relates to a caliper-type bow string release for archery. Such bow string releases are used by the user applying his trigger finger to apply pressure to pull the trigger, opening the jaws for loading and relaxing tension on trigger, closing the jaws around the bowstring. Such systems allow the archer to maintain one grasping finger-hand position to load and fire release. Even though many previous styles of releases can be manipulated to load on to a bowstring, it can be awkward at best. For example, earlier releases do not rotate nor allow the user to adjust the actual trigger pressure force required to fire the release.

Archery enthusiasts have never had a release available that features caliper jaws with 360-degree selectable rotation, provided by sealed ball bearings. This rotation should be in front of the trigger, which eliminates the possibility of torque being applied to the bowstring and allows for unlimited hand anchoring options that are impossible with non-rotating releases. There is also a need for the ability to easily adjust without tools the trigger pressure force required in firing the release, which is completely independent from affecting trigger travel and does not aid in the closing of the locking mechanism. These features should be combined with affordability, accuracy, ease of use, and reliability. The release must be adaptable to any style of shooting, and must be easily loaded on to a string loop or similar device. The jaws of the release should be very small in profile. This enables it to be used on all rigid center-nocking devices without having to trim arrow nocks to use them. The caliper jaws should open widely to easily load directly on to a bowstring.

Earlier U.S. patents show devices with some similarities but also several deficiencies. Examples are U.S. Pat. Nos. 5,417,197; 5,564,407; 5,582,158. The Classic Caliper has automatic latching features. The present invention has no such feature or means to accomplish that but is loaded manually by actuating the trigger. These patents disclose a push-pull, rocking mode of trigger operation to fire the release. In contrast, the present invention employs a trigger utilizing a novel ramped trigger actuator to increase the throw of the sear components with minimum input from the trigger. This decreases trigger travel necessary to fire and gives the release the quick on the edge feel the shooters crave with very low trigger pressure required to fire the release.

Earlier designs disclose a cam actuator moveable between the jaws mounted on a stem, designed to maintain the jaws in a latched open condition. The cam actuator of the present invention is designed to do the opposite, that is, to close the jaws automatically. These designs include a cam and jaw that were designed having surfaces that define trigger force adjustment. These surfaces are sear elements relying on complex cam surfaces, contact angles and positional relationships to increase or decrease sliding frictional forces seen at the trigger. This repositioning of sear elements requires precise minuscule adjustments, being careful not to make large unwanted changes in trigger pressure force. This changing of sear element positions also allows the user to set the device into an unsafe condition mistakenly while trying to adjust trigger pressure forces. These changes are made by locating a small socket set screw installed in cylindrical member, insertion of a small hex wrench loosening socket set screw while maintaining the wrench in the socket of the set screw and rotating the head and jaws to new setting, tightening the set screw to complete adjustment, and hoping you have not turned anything in a wrong direction. Additionally these earlier designs do not allow the user to preview the trigger pressures force settings selected: one must simulate loading and firing the mechanism.

The present invention has separated the trigger pressure force adjustment means from the sear components. The user may now preview their setting by simple trigger pulling action. This design does not require one to simulate loading and firing the mechanism. Since sear components are not adjusted to achieve varied trigger pressure forces, the present invention cannot be adjusted into an unsafe condition by manipulating this mechanism. The design of the present invention provides the means to adjust trigger pressure by rotation of a dial with a minimum of two fingers, and this may be done with the same hand the release is installed on (shooting hand).

SUMMARY OF THE INVENTION

An adjustable trigger pressure archery release apparatus for use on a bow having a bowstring, the apparatus comprising:

(a) a body;

(b) a head having a pair of pivoting jaws adapted to grip the bowstring, the head rotating three hundred sixty degrees in relation to the body on ball bearings;

(c) a jaw operating mechanism causing the jaws to pivot between a closed position wherein the jaws are adapted to grip the bowstring and an open position wherein the jaws are adapted to release the bowstring; and (d) a trigger associated to the jaw operating mechanism.

A principal object and advantage of the present invention is that it employs a novel ramped trigger actuator to increase the throw of the sear components with minimum input from the trigger.

Another principal object and advantage of the present invention is that it has a trigger pressure adjustment separate from the sear components, allowing the archer to preview trigger pressure by a simple pulling trigger action.

Another principal object and advantage of the present invention is that the trigger pressure adjustment cannot be used to inadvertently adjust the release to an unsafe condition.

Another principal object and advantage of the present invention is that the head with the caliper jaws may rotate 360 degrees relative to the body on ball bearings, thus greatly decreasing torque on the bowstring.

Another principal object and advantage of the present invention is that the head may be prevented from rotating by a simple set screw.

Another principal object and advantage of the present invention is that the pressure adjustment mechanism has a means to maintain a selected setting to prevent accidental inadvertent movement of the dial when rubbed against a pocket during insertion or removal.

Another principal object and advantage of the present invention is that the archer may use the same hand to manipulate the pressure adjustment mechanism that the release is installed on, freeing the other hand to hold the bow. Two hands to operate the mechanism are not required.

Another principal object and advantage of the present invention is use of a bayonet mounting style trigger installation, wherein the trigger is easily installed onto the pull pin in assembly and in conjunction with body, encases the trigger, preventing trigger removal.

Another principal object and advantage of the present invention is a trigger spring seat that aligns and guides the compression spring to prevent the spring from interfering with the trigger and body when the trigger is pulled. This also allows spreading the load evenly and offers increased contact area to communicate with the trigger.

DETAILED DESCRIPTION OF THE PREFERRED EMBODIMENT

Figure 1:
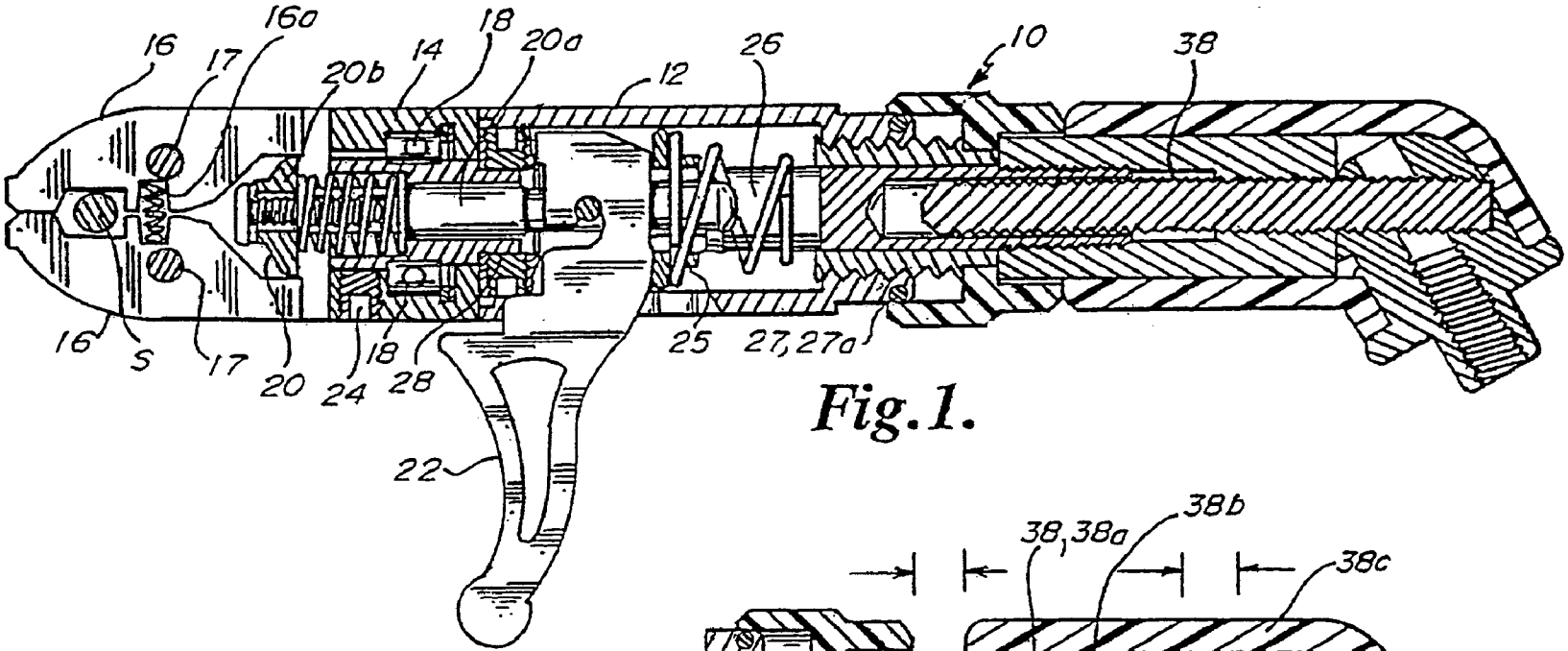
FIG. 1 is a side elevation view of the device with structure cut away to show internal structure with the jaws in the closed position.
Figure 2:
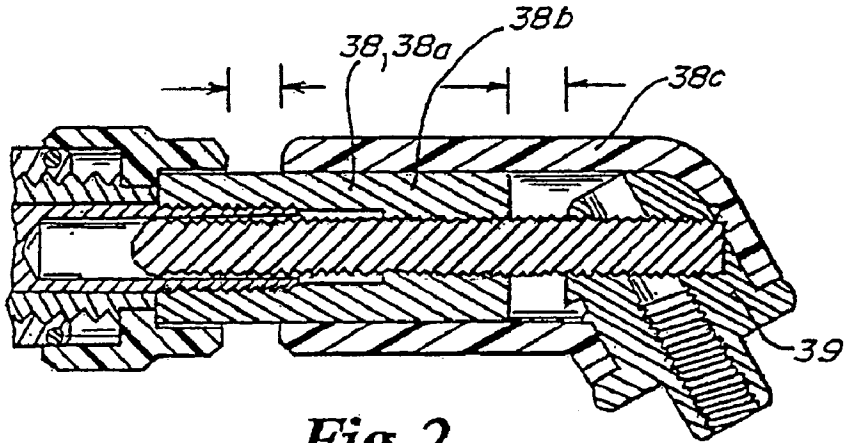
FIG. 2 is similar to FIG. 1, particularly in the right end of the drawing, showing the length adjustment mechanism.

The adjustable trigger pressure archery release of the present invention is generally shown in the Figures as reference numeral 10.

Figure 3:
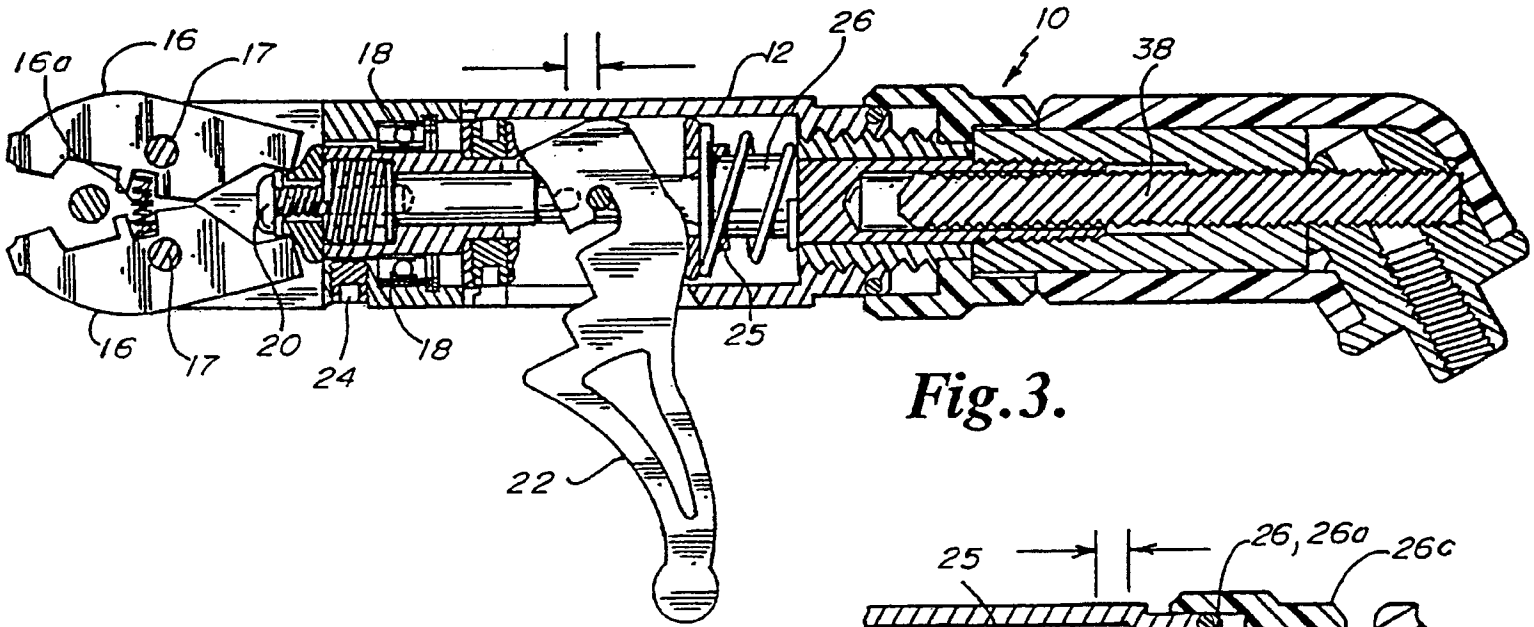
FIG. 3 is similar to FIG. 1, showing the jaws in the open position.

In one aspect the present invention is an adjustable trigger pressure archery release 10 for use on a bow (not shown) having a bowstring S, the apparatus 10 comprising a body 12, a head 14 having a pair of pivoting caliper jaws 16 adapted to grip the bowstring S, the jaws pivoting on pivot pins or jaw drive pins 17, the head rotating 360 degrees in relation to the body on ball bearings 18; a jaw operating mechanism 20 causing the jaws to pivot between a closed position (FIG. 1) wherein the jaws 16 are adapted to grip the bowstring S and an open position (FIG. 3) in which the jaws 16 are adapted to release the bowstring S; a trigger 22 associated to the jaw operating mechanism 20; and a detent mechanism or head lock fastener 24 adjustable by the archer to prevent the head 14 from rotating in relation to the body 12.

In the preferred embodiment, the apparatus 10 further comprises a trigger pressure adjustment mechanism 26 separate from the jaw operating mechanism 20. It should be understood that because the trigger pressure adjustment mechanism 26 is completely separate from the jaw operating mechanism 20, the trigger pressure adjustment mechanism 26 is optional.

In the preferred embodiment, the apparatus 10 further comprises a trigger travel adjustment mechanism 28 separate from the trigger pressure adjustment mechanism 26. Most preferably, the trigger 22 is associated to the jaw operating mechanism 20 by a trigger cam follower 30 (FIG. 5) engaging a cam or trigger actuator 32 on the jaw operating mechanism 20. The trigger travel adjustment mechanism 28 then further comprises a mechanism 34 to change the position of the cam follower 30 on the cam 32. Preferably, the mechanism 34 is a trigger travel adjustment set screw 36. In this embodiment, the jaws 16 are biased to an open position by a jaw spring 16*a* and the jaw operating mechanism 20 further comprises a pull pin 20*a* connected to the trigger 22 by a trigger pivot pin 22*a*, a pull pin head 20*b*, and a pull pin spring 20*c* causing the pull pin head 20*b* to operate against the pull pin spring 20*c*. The pull pin head 20*b* further comprises opposed pull pin head cams 21*a* on each side of the pull pin 20*a* and each jaw 16 further comprises a jaw cam follower 21*b* engaging the pull pin head cams 21*a*.

Figure 4:
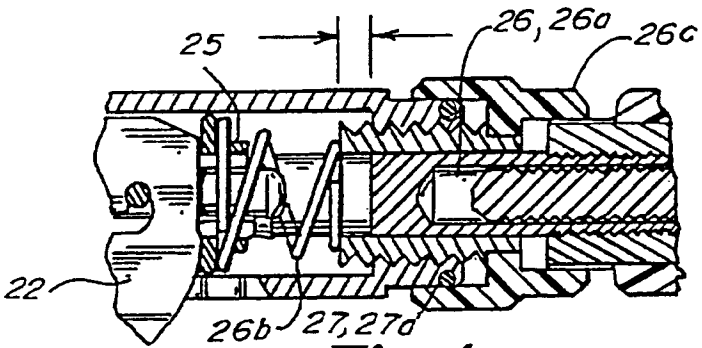
FIG. 4 is a detail of the trigger force adjustment mechanism.

In the preferred embodiment, the trigger pressure adjustment mechanism 26 further comprises a threaded adjuster 26*a* and a trigger pressure spring 26*b* opposing the motion of the trigger 22. The threaded adjuster 26*a* changes the compression of the spring 26*b* against the trigger 22. See FIG. 4. The mechanism 26 may also preferably further comprise a trigger pressure adjustment dial 26*c* settable by the archer, the trigger pressure adjustment dial 26*c* engaging the threaded adjuster 26*a*. The mechanism 26 may also preferably include a mechanism 27 to maintain the selected pressure setting to prevent accidental or inadvertent movement of the dial 26*c*. The mechanism 27 is preferably a frictional element 27*a* such as a compressed elastomeric member captured within the dial 26*c*.

Preferably, the trigger pressure spring 26*b* seats against a trigger spring seat 25 that aligns and guides the spring 26*b* to prevent the spring 26*b* from interfering with the trigger 22 and the body 12 when the trigger 22 is pulled. The trigger spring seat 25 also allows spreading the load of the spring evenly and offers an increased contact area to communicate with the trigger.

Figure 6:
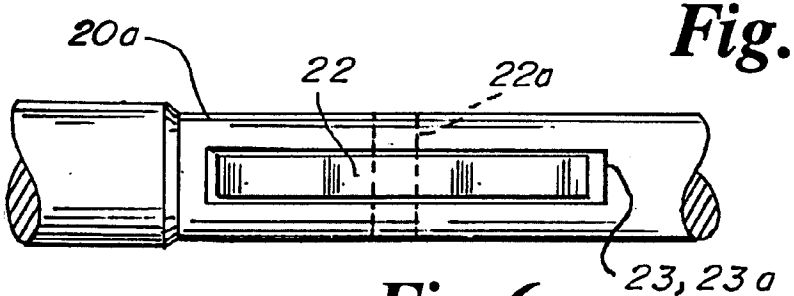
FIG. 6 is a detail of the trigger bayonet style mount.

Preferably, the trigger 22 is mounted to the body 12 by a bayonet-style mount 23. (FIG. 6) The bayonet style mount 23 includes a slot 23*a* in the pull pin 20*a* through which the trigger 22 is inserted onto the trigger pivot pin 22*a*. The mount 23 and body 12 capture the trigger, preventing trigger removal. In addition, the trigger is easily installed on the mount 23 during assembly.

In the preferred embodiment, the apparatus 10 may also comprise a length adjuster 38 adjusting the length of the body 12 between the archer's hand (not shown) and the bowstring S. The length adjuster 38 preferably comprises an adjusting rod 38*a* threaded externally, an adjusting sleeve 38*b* threadably engaging the adjusting rod 38*a*, and a friction tube 38*c* fixedly attached to the adjusting sleeve 38*b*.

The following is a description of how the archer might typically use the invention. However, it should be understood that the order of taking the various actions may vary depending upon the archer's needs and the conditions under which the invention is used.

Typically, the archer would set the length adjuster 38 so that the finger he intends to use on the trigger is comfortably on the trigger. The archer turns the adjusting sleeve 38*b*, or apparatus 10, either clockwise or counterclockwise to increase or decrease the length of the body 12. The friction tube 38*c* and adjusting rod, being fixed to the swing adapter 39, causes the adjusting sleeve 38*b* to turn, and apparatus 10 to turn, either increasing or decreasing the length of the body 12.

Next, the archer would set the trigger pressure desired by turning the trigger pressure adjustment dial 26*c*, causing the threaded adjuster 26*a* to change the compression of the spring 26*b* against the trigger 22. The trigger pressure can be tested without loading the jaws onto the string S because the trigger pressure adjustment mechanism 26 is separate from the jaw operating mechanism 20.

Figure 5:
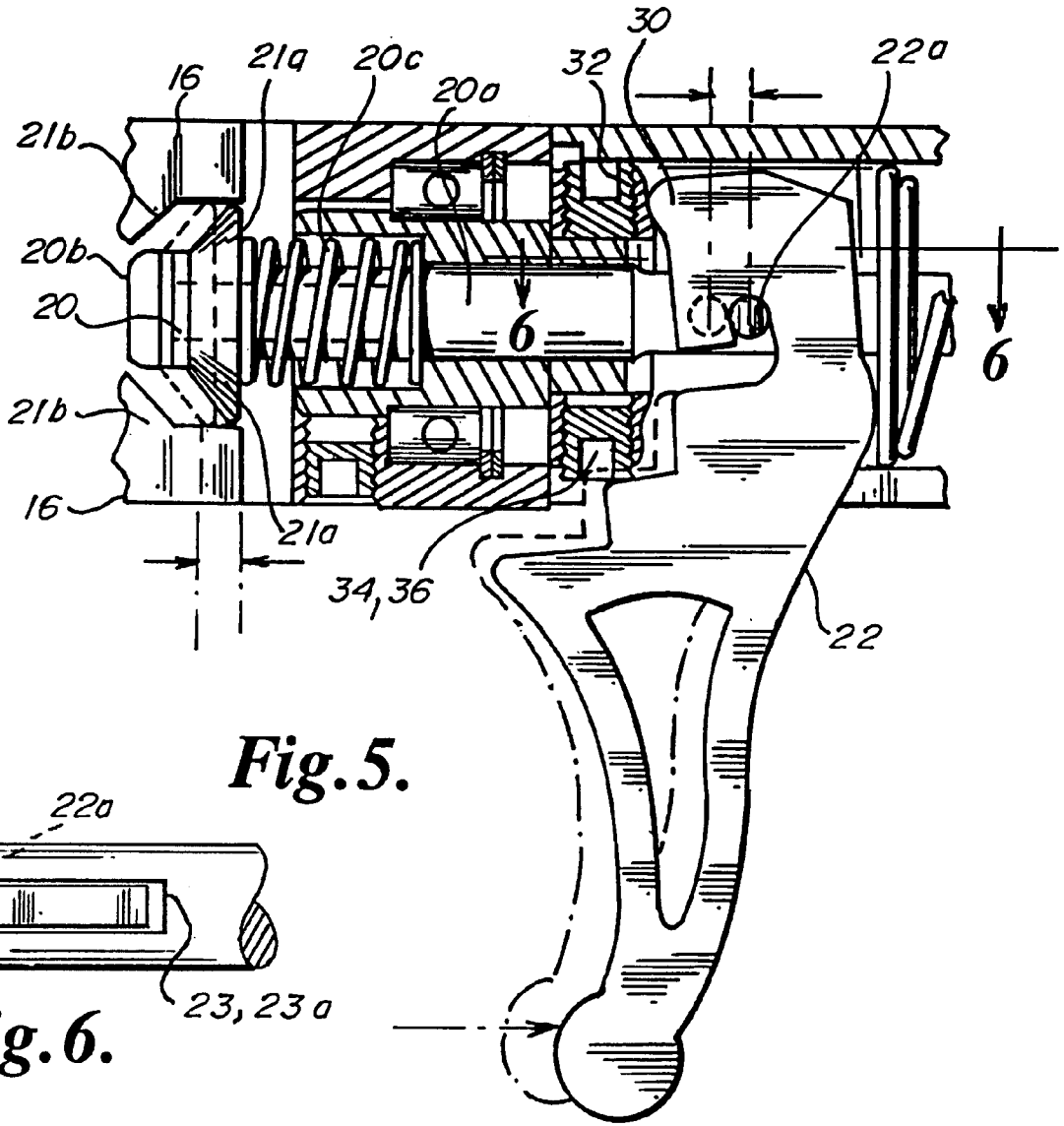
FIG. 5 is a detail of the trigger travel or sensitivity adjustment mechanism.

Next, the archer would set the desired trigger travel or sensitivity to either require a long pull at one extreme or a "hair trigger" at the other extreme. Using an appropriate tool such as an Allen wrench, the archer turns the trigger travel adjustment set screw 36. Backing the screw 36 out causes the screw 36 to bear against the trigger as shown in FIG. 5. This in turn causes the trigger to move toward the archer and away from the jaws, at the same time the trigger pivot pin 22*a* acting on the pull pin 20*a* causes the pull pin head cams

21*a* to move along the jaw cam followers 21*b*, making the jaws more responsive to the trigger 22. The changes in the various components are shown as they move from the phantom lines to the solid lines in FIG. 5. The motion of the trigger 22 also causes the trigger cam follower 30 to move to a higher point along the trigger actuator or cam 32. At the position shown in the solid lines in FIG. 5, very little trigger travel is required to cause the jaws to open, as the pull pin head cams 21*a* move off the jaw cam followers 21*b* and the jaw spring 16*a* opens the jaws, releasing the bowstring S, and the trigger is then a "hair trigger."

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. An adjustable trigger pressure archery release apparatus for use on a bow having a bowstring, the apparatus comprising:

a body;

a head having a pair of pivoting jaws adapted to grip the bowstring, the head rotating three hundred sixty degrees in relation to the body on ball bearings;

a jaw operating mechanism causing the jaws to pivot between a closed position wherein the jaws are adapted to grip the bowstring and an open position wherein the jaws are adapted to release the bowstring;

a trigger associated to the jaw operating mechanism; and a mechanism adjustable by the archer to prevent the head from rotating in relation to the body.

2. The apparatus of claim 1, further comprising a trigger pressure adjustment mechanism separate from the jaw operating mechanism.

3. The apparatus of claim 2, further comprising a trigger travel adjustment mechanism separate from the trigger pressure adjustment mechanism.

4. The apparatus of claim 3, wherein the trigger is associated to the jaw operating mechanism by a trigger cam follower engaging a cam on the jaw operating mechanism, and wherein the trigger travel adjustment mechanism further comprises a mechanism to change the position of the trigger cam follower on the cam.

5. The apparatus of claim 4, wherein the mechanism to change the position of the cam follower on the cam further comprises a set screw.

6. The apparatus of claim 4, wherein the jaws are biased to an open position by a jaw spring and wherein the jaw operating mechanism further comprises a pull pin associated to the trigger, a pull pin head, and a pull pin spring causing the pull pin head to operate against the jaw spring.

7. The apparatus of claim 6, wherein the pull pin head further comprises opposed pull pin head cams on each side of the pull pin and wherein each jaw further comprises a jaw cam follower engaging the pull pin head cams.

8. The apparatus of claim 2, wherein the trigger pressure adjustment mechanism further comprises a threaded adjuster and a spring opposing the motion of the trigger, wherein the threaded adjuster changes the compression of the spring against the trigger.

9. The apparatus of claim 8, further comprising a trigger pressure adjustment dial settable by the archer, the trigger pressure adjustment dial adjusting the compression of the spring.

10. The apparatus of claim 1, further comprises a length adjuster adjusting the length of the body between the archer's hand and the bowstring.

11. An adjustable trigger pressure archery release apparatus for use on a bow having a bowstring, the apparatus comprising:

a body;

a head having a pair of pivoting jaws adapted to grip the bowstring, the head rotating three hundred sixty degrees in relation to the body on ball bearings;

a jaw operating mechanism causing the jaws to pivot between a closed position wherein the jaws are adapted to grip the bowstring and an open position wherein the jaws are adapted to release the bowstring;

a trigger associated to the jaw operating mechanism by a trigger actuator;

wherein the trigger actuator further comprises a cam follower and a cam, the cam follower bearing on the cam; and a trigger travel adjustment mechanism comprising a mechanism to change the position of the cam follower on the cam.

12. The apparatus of claim 11, further comprising a trigger pressure adjustment mechanism separate from the jaw operating mechanism.

13. The apparatus of claim 12, wherein the trigger travel adjustment mechanism is separate from the trigger pressure adjustment mechanism.

14. The apparatus of claim 12, wherein the trigger pressure adjustment mechanism further comprises a threaded adjuster and a spring opposing the motion of the trigger, wherein the threaded adjuster changes the compression of the spring against the trigger.

15. The apparatus of claim 14, further comprising a trigger pressure adjustment dial settable by the archer, the trigger pressure adjustment dial adjusting the compression of the spring.

16. The apparatus of claim 11, wherein the mechanism to change the position of the cam follower on the cam further comprises a set screw.

17. The apparatus of claim 11, further comprises a length adjuster adjusting the length of the body between the archer's hand and the bowstring.

18. The apparatus of claim 11, wherein the jaws are biased to an open position by a jaw spring and wherein the jaw operating mechanism further comprises a pull pin associated to the trigger, a pull pin head, and a pull pin spring causing the pull pin head to operate against the jaw spring.

19. The apparatus of claim 18, wherein the pull pin head further comprises opposed pull pin head cams on each side of the pull pin and wherein each jaw further comprises a jaw cam follower engaging the pull pin head cams.

20. An adjustable trigger pressure archery release apparatus for use on a bow having a bowstring, the apparatus comprising:

a body;

a head having a pair of pivoting jaws adapted to grip the bowstring, the head rotating three hundred sixty degrees in relation to the body on ball bearings;

a jaw operating mechanism causing the jaws to pivot between a closed position wherein the jaws are adapted to grip the bowstring and an open position wherein the jaws are adapted to release the bowstring;

a trigger associated to the jaw operating mechanism by a trigger actuator;

wherein the trigger actuator further comprises a cam follower and a cam, the cam follower bearing on the cam;

a trigger travel adjustment mechanism comprising a mechanism to change the position of the cam follower on the cam; and a trigger pressure adjustment mechanism separate from the jaw operating mechanism and from the trigger travel adjustment mechanism.

21. The apparatus of claim 20, wherein the mechanism to change the position of the cam follower on the cam further comprises a set screw.

22. The apparatus of claim 20, wherein the trigger pressure adjustment mechanism further comprises a threaded adjuster and a trigger pressure spring opposing the motion of the trigger, wherein the threaded adjuster changes the compression of the spring against the trigger.

23. The apparatus of claim 22, further comprising a trigger pressure adjustment dial settable by the archer, the trigger pressure adjustment dial adjusting the compression of the spring.

24. The apparatus of claim 23, further comprising a mechanism to maintain the trigger pressure adjustment mechanism at a selected setting.

25. The apparatus of claim 24, wherein the mechanism to maintain the trigger pressure adjustment mechanism at a selected setting further comprises a compressed, frictional, elastomeric member captured by the trigger pressure adjustment dial.

26. The apparatus of claim 22, further comprising a trigger spring seat that aligns and guides the trigger pressure spring to prevent the trigger pressure spring from interfering with the trigger and the body when the trigger is pulled, spreads the load of the trigger pressure spring evenly, and increases the contact area for the trigger pressure spring with the trigger.

27. The apparatus of claim 20, further comprises a length adjuster adjusting the length of the body between the archer's hand and the bowstring.

28. The apparatus of claim 20, wherein the jaws are biased to an open position by a jaw spring and wherein the jaw operating mechanism further comprises a pull pin associated to the trigger, a pull pin head, and a pull pin spring causing the pull pin head to operate against the jaw spring.

29. The apparatus of claim 28, wherein the pull pin head further comprises opposed pull pin head cams on each side of the pull pin and wherein each jaw further comprises a jaw cam follower engaging the pull pin head cams.

30. The apparatus of claim 28, wherein the trigger is mounted within the body by a bayonet style mount, thereby preventing removal of the trigger after assembly of the apparatus.

31. The apparatus of claim 30 wherein the bayonet style mount further comprises a slot in the pull pin receiving the trigger pivot pin on which the trigger pivots.

* * * * *